US005237376A

United States Patent [19]

Giardina

[11] Patent Number: 5,237,376

[45] Date of Patent: Aug. 17, 1993

[54] CLEANING NOZZLE FOR A CLEANING STATION IN A REPRODUCTION APPARATUS

[75] Inventor: Jamie S. Giardina, Webster, N.Y.

[73] Assignee: Eastman Kodak Company, Rochester, N.Y.

[21] Appl. No.: 824,680

[22] Filed: Jan. 23, 1992

[51] Int. Cl.[5] ..... G03G 21/00

[52] U.S. Cl. ..... 355/301; 15/256.52; 355/298; 355/302

[58] Field of Search ..... 355/296, 297, 298, 299, 355/301, 302, 215; 15/256.5, 256.51, 256.52; 118/652

[56] References Cited

U.S. PATENT DOCUMENTS

| | | | |
|---|---|---|---|
| 3,654,901 | 4/1972 | Donohue et al. | 118/637 |
| 3,807,853 | 4/1974 | Hudson | 355/298 |
| 4,113,376 | 9/1978 | Rodda | 355/301 |
| 4,165,171 | 8/1979 | Lemmen | 355/296 |
| 4,304,026 | 12/1981 | Borostyan | 15/308 |
| 4,664,505 | 5/1987 | Itaya et al. | 15/256.1 X |
| 4,797,708 | 1/1989 | Kasiske, Jr. et al. | 355/296 |
| 4,823,153 | 4/1989 | Coburn | 346/160.1 |
| 4,851,880 | 7/1989 | Ziegelmuller et al. | 355/302 |
| 5,066,983 | 11/1991 | Tonomoto | 355/297 |
| 5,091,753 | 2/1992 | Slapelis | 355/297 |

*Primary Examiner*—Lincoln Donovan
*Assistant Examiner*—Christopher Horgan
*Attorney, Agent, or Firm*—David A. Howley

[57] ABSTRACT

In accordance with the invention, there is provided an improved cleaning nozzle for use in a cleaning station of a reproduction apparatus. A vacuum is applied through the cleaning nozzle to remove debris from a cleaning brush located in the cleaning station. The cleaning nozzle, which protrudes into the brush, includes a member defining a slot through which the vacuum may be applied. The member has an essentially flat leading end which protrudes into the brush and which defines a tapered entrance to the slot. In a modification of the invention, the nozzle protrudes into the brush by a distance in the range of between about 0.025 cm and 0.050 cm, preferably 0.038 cm. Additionally, the entrance to the slot is tapered from the leading end by an angle of about between 50 and 70 degrees, preferably 60 degrees.

10 Claims, 2 Drawing Sheets

CLEANING NOZZLE FOR A CLEANING STATION IN A REPRODUCTION APPARATUS

FIELD OF THE INVENTION

This invention relates generally to reproduction apparatus and specifically to a cleaning nozzle for removing debris from a cleaning brush for an image developing surface of such an apparatus.

BACKGROUND OF THE INVENTION

In a typical electrostatographic reproduction apparatus, a photoconductive member has a uniform charge applied to it. The member is then imagewise exposed to light to selectively discharge the member, leaving behind an electrostatic latent image. This image is developed with toner to form a visible image. The visible image is transferred to a receiver sheet to which the image is permanently fixed by heat and/or pressure. To prepare the photoconductive member for the next copying cycle, the member is cleaned by a cleaning station. This cleaning station removes debris, such as background toner, dirt, carrier particles and receiver sheet fillers, from the member.

One type of cleaning station utilizes a cleaning brush and a cleaning nozzle to accomplish cleaning of the photoconductive member. The brush includes a core which has acrylic fibers attached to it's outer surface. The cleaning brush is located proximate the photoconductive member such that the fibers engage the member. Preferably, the brush is rotated in the opposite direction from which the photoconductive member is traveling. The fibers remove debris from the member. In order to prevent the cleaning brush from becoming clogged with debris, a cleaning nozzle is used to remove the debris from the brush . The nozzle protrudes slightly into the fibers of the brush, and a vacuum, applied through the nozzle, removes the debris from the brush.

A problem with this cleaning nozzle is that scum, consisting of melted toner, receiver sheet fillers and acrylic fibers from the brush, builds up on the nozzle. The scum is very brittle and abrasive. Frequent cleaning of the nozzle is required to prevent scum buildup. In addition, once the nozzle becomes scummed, the nozzle can no longer effectively remove debris from the brush. This debris that remains in the brush can be redeposited on the photoconductive member, causing nonuniform background in the finished copy. A further problem is that pieces of the scum periodically break off from the nozzle. Some of these pieces of scum are transported by the brush to the photoconductive member where the pieces can cause large digs in the member. These digs show up as spots and/or background defects in copies. The life of the photoconductive member is thus tremendously shortened as a result of this problem.

SUMMARY OF THE INVENTION

In accordance with the invention, there is provided an improved cleaning nozzle for use in a cleaning station of an electrostatographic reproduction apparatus. A vacuum is applied through the cleaning nozzle to remove debris from a cleaning brush located in the cleaning station. The improved cleaning nozzle, which protrudes into the brush, includes a member defining a slot through which the vacuum may be applied. The member has an essentially flat leading end which protrudes into the brush and which defines a tapered entrance to the slot.

In a modification of the invention, the improved cleaning nozzle protrudes into the brush by a distance in the range of between about 0.025 cm and 0.050 cm, preferably 0.038 cm. Additionally, an entrance to the slot is tapered from the leading end, when measured from a plane which includes the leading end, at an angle in the range of between about 50 and 70 degrees, preferably about 60 degrees.

The invention, and its objects and advantages, will become more apparent in the detailed description of the preferred embodiment presented below.

BRIEF DESCRIPTION OF THE DRAWINGS

In the detailed description of the preferred embodiment of the invention presented below, reference is made to the accompanying drawings, in which.

DESCRIPTION OF THE PREFERRED EMBODIMENT

Figure 1:
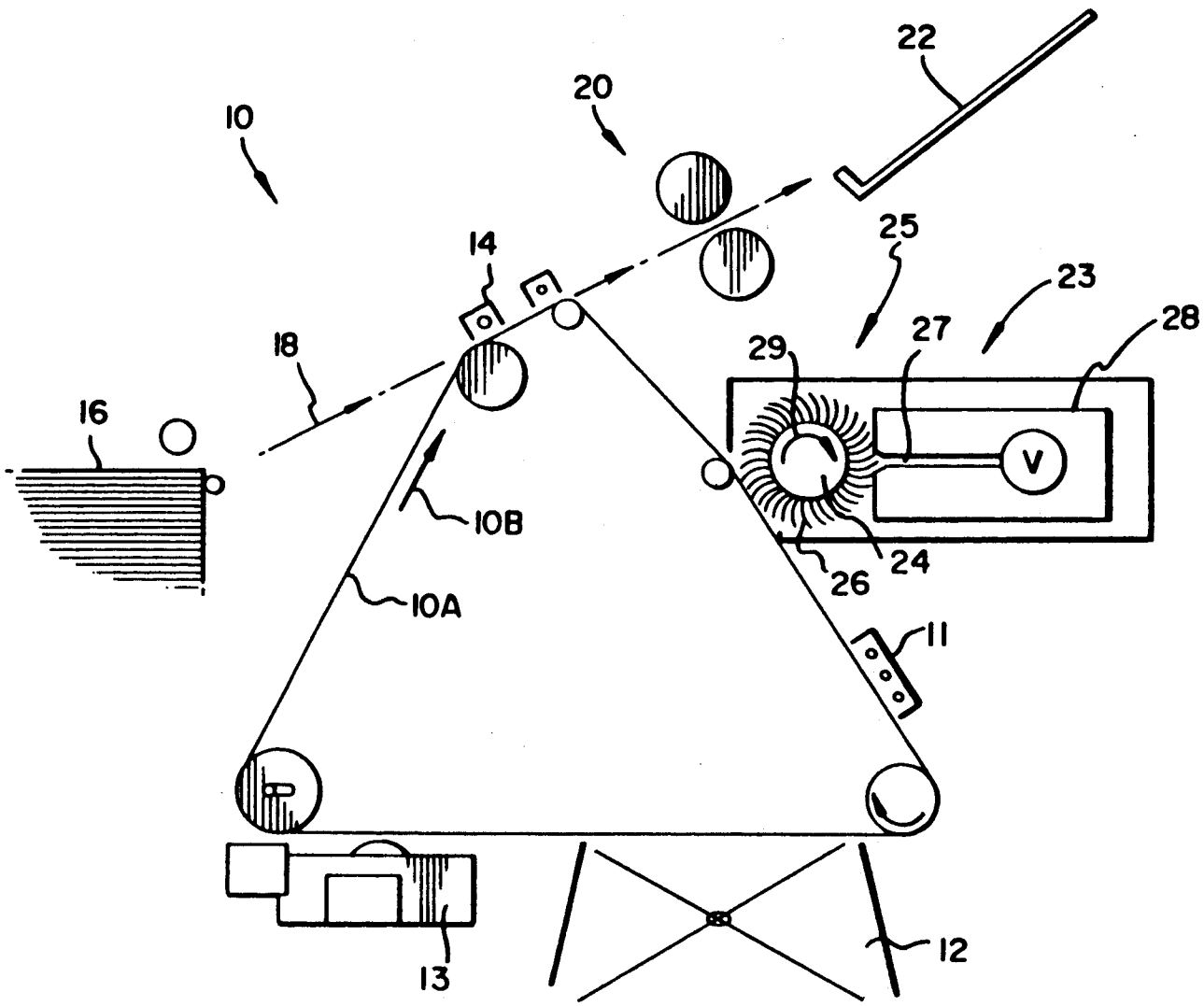
FIG. 1 is a side schematic view of an electrophotographic copier including an improved cleaning nozzle according to this invention.

The present invention will be described with respect to an electrostatographic copier which is designated generally by the reference numeral 10 in FIG. 1. An endless web 10A, made of a composite material which includes a grounded conductive layer and a photoconductive layer, is rotated in the direction of an arrow 10B about a fixed, closed loop path. A corona charger 11 applies a uniform electric charge to an image developing surface of web 10A. An exposure station 12 imagewise exposes the web to light corresponding to information to be copied. This exposure discharges web 10A where light strikes it, leaving behind an electrostatic latent image of such information on the web. A toning station 13 develops the latent image with pigmented marking particles called toner. This creates a visible image on the image developing surface of web 10A. A receiver sheet, such as a cut sheet of plain bond paper, is fed from a receiver sheet supply 16 along a path 18 and onto web 10A. The feed is such that the receiver sheet overlies the visible image of toner. A transfer station 14 (such as a corona charger or a biased roller) is utilized to transfer the visible image from the web to the receiver sheet. The receiver sheet continues along path 18 to a fusing station 20 which permanently fixes the visible image to the receiver sheet by heat and/or pressure. Finally, the receiver sheet is deposited in an exit tray 22.

In order to prepare the image developing surface of web 10A for the next copying cycle, a cleaning station, designated generally by the reference number 23, cleans the surface of the web of debris such as background toner, dirt, carrier particles and receiver sheet fillers. A cleaning brush, designated generally as 25, includes a cylindrical core 24 and fibers 26 attached to the core. Preferably the fibers are made of an acrylic material. The core, preferably rotatable in the direction of arrow 29, is located such that the fibers contact the surface of web 10A. As core 24 rotates, fibers 26 remove debris from the surface of the web. A cleaning nozzle 28, according to the invention, is utilized to remove the debris from brush 25. The cleaning nozzle protrudes into fibers 26. A vacuum pump V is connected to a slot 27. The vacuum pump applies a vacuum through slot 27 which draws the debris out of brush 25. The cleaning nozzle prevents a buildup of debris on the cleaning brush.

Figure 2:
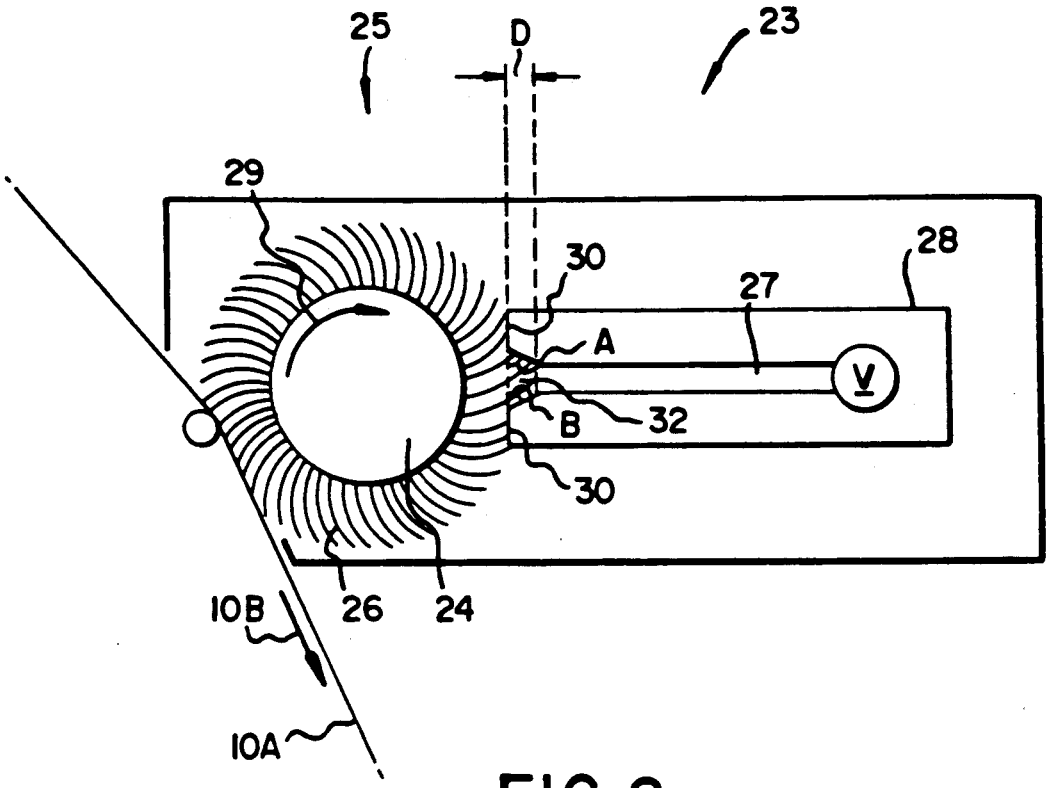
FIG. 2 is a side schematic view, on an enlarged scale, of the cleaning nozzle engaging a cleaning brush.
Figure 3:
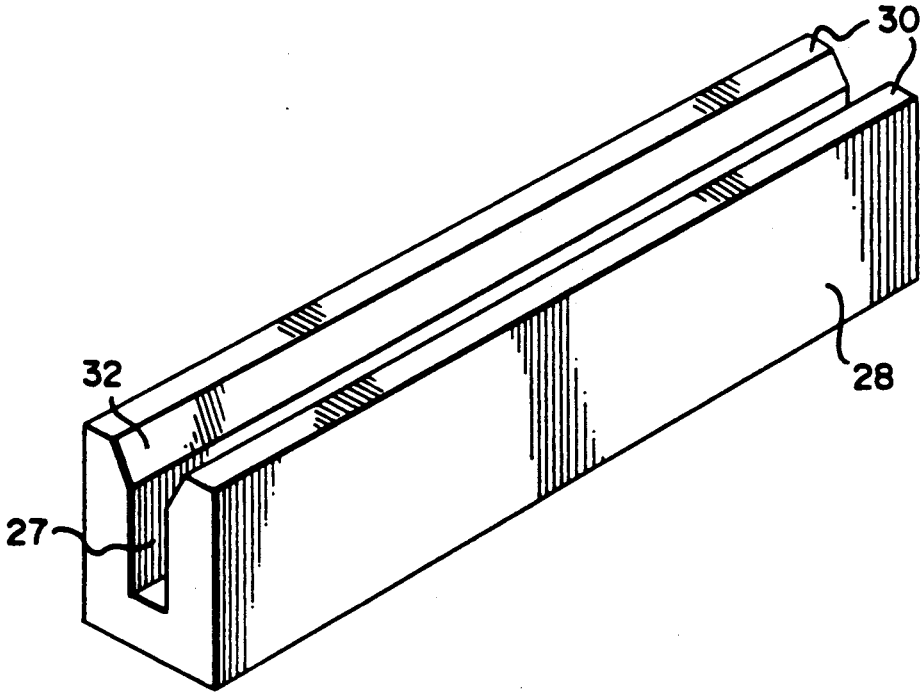
FIG. 3 is a perspective view of the cleaning nozzle of FIG. 2.

With reference to FIGS. 2 and 3, cleaning nozzle 28, representative of the present invention, is displayed protruding into cleaning brush 25. Nozzle 28 is made of a rigid material, such as extruded aluminum, and extends substantially the entire length of cleaning brush 25 (into the plane of FIG. 2). While the prior art nozzle protrudes into the brush fibers about 0.15 cm, nozzle 28 only protrudes into fibers 26 a distance D in the range of about between 0.025 cm and 0.050 cm, preferably about 0.038 cm.

A leading end 30 of nozzle 28 defines an entrance 32 to slot 27. In nozzles found in prior art cleaning stations, the departure from the leading end into the slot was a sharp angle of about 90 degrees. It is believed that this configuration contributed to the aforementioned scum buildup. In the present invention, the departure from leading end 30 into slot 27 is tapered. When measured from a plane which includes the leading end, departure angles A and B from leading end 30 into entrance 32 of slot 27 are in the range of about between 50 and 70 degrees, about 60 degrees. By tapering the entrance to the slot, scum buildup is tremendously reduced.

A further distinction between the prior art nozzle and the nozzle representative of the present invention is that leading end 30 of nozzle 28 is essentially flat whereas in the prior art nozzle, the leading end has a more rounded shape. This change in shape of the leading end from rounded to flat also helps to greatly reduce scum buildup on the nozzle.

It has been found that there was very little scum buildup on the nozzle embodying the present invention after a very large number of copies were produced. As a result, debris buildup on the photoconductive member and break off of scum pieces is substantially prevented, and accordingly, the life of the photoconductive member is greatly extended. Further, the frequency of cleaning of the nozzle has been tremendously reduced.

The invention has been described in detail with particular reference to a preferred embodiment thereof, but it will be understood that variations and modifications can be effected within the spirit and scope of the invention.

What is claimed is:

1. In a cleaning station of a reproduction apparatus, an improved cleaning nozzle through which a vacuum may be applied to remove debris from a cleaning brush, said improved cleaning nozzle comprising:

a member defining a slot through which said vacuum may be applied, said member having an essentially flat leading end which protrudes into said brush and which defines a tapered entrance to said slot, said entrance being tapered from said leading end, measured from a plane which includes said leading end, at an angle in the range of between about 50 and 70 degrees.

2. The nozzle as defined in claim 1, wherein said leading end protrudes into said brush a distance in the range of between about 0.0254 cm and 0.0508 cm.

3. The nozzle as defined in claim 2, wherein said leading end protrudes into said brush a distance of about 0.0381 cm.

4. The nozzle as defined in claim 1, wherein said entrance to said slot is tapered from said leading end at an angle of about 60 degrees.

5. The nozzle as defined in claim 2, wherein said entrance to said slot is tapered from said leading end, measured from a plane which includes said leading end, at an angle in the range of between about 50 and 70 degrees.

6. The nozzle as defined in claim 5, wherein said entrance to said slot is tapered from said leading end at an angle of about 60 degrees.

7. In an image reproduction apparatus, a cleaning station for removing debris from an image developing surface, said cleaning station comprising:

a cleaning brush including a rotatable core and a plurality of fibers attached to said core, said core being positioned relative to said image developing surface such that when said core is rotated said fibers will contact said surface and remove debris from the surface;

a vacuum pump; and a member defining a slot through which a vacuum may be applied by said vacuum pump, said slot being connected to said vacuum pump, said member having an essentially flat leading end which protrudes into said fibers and which defines a tapered entrance to said slot for removing said debris from said cleaning brush, said entrance being tapered from said leading end, measured from a plane which includes said leading end, at an angle in the range of between about 50 and 70 degrees.

8. The cleaning station as defined in claim 7, wherein said leading end protrudes into said fibers a distance in the range of between about 0.025 cm and 0.050 cm.

9. The cleaning station as defined in claim 8, wherein said leading end protrudes into said fibers a distance of about 0.038 cm.

10. The cleaning station as defined in claim 7, wherein said entrance to said slot is tapered from said leading end at an angle of about 60 degrees.

* * * * *